US005115470A

United States Patent [19]

Sutheim

[11] Patent Number: 5,115,470

[45] Date of Patent: May 19, 1992

[54] SOUND REINFORCEMENT SYSTEM

[76] Inventor: Peter E. Sutheim, 5146 Almaden Dr., Los Angeles, Calif. 90042

[21] Appl. No.: 515,077

[22] Filed: Apr. 11, 1990

[51] Int. Cl.[5] ..... H04R 27/00

[52] U.S. Cl. ..... 381/76; 381/83; 381/155; 381/188; 381/205

[58] Field of Search ..... 381/76, 83, 92, 93, 381/155, 87, 88, 90, 188, 205, 24, 182, 169, 172

[56] References Cited

U.S. PATENT DOCUMENTS

| | | | |
|---|---|---|---|
| 1,890,742 | 12/1932 | Messmer | 381/83 |
| 3,370,125 | 2/1968 | Shaw et al. | 381/76 |
| 3,443,031 | 5/1969 | Bolick, Jr. | 381/76 |
| 3,536,862 | 10/1970 | Weingartner | 381/155 |
| 3,722,616 | 5/1973 | Beavers | 381/155 |
| 3,992,586 | 11/1976 | Jaffe | 381/83 |

FOREIGN PATENT DOCUMENTS

| | | | |
|---|---|---|---|
| 0205586 | 9/1939 | Switzerland | 381/188 |

*Primary Examiner*—Forester W. Isen
*Assistant Examiner*—Sylvia Chen
*Attorney, Agent, or Firm*—J. E. McTaggart

[57] ABSTRACT

For improved sound reinforcement, especially of the human voice, in situations where clarity and full audience coverage are important, an integrated structure supports a microphone and a speaker unit in an anti-feedback spatial relationship. The single speaker unit, mounted in an elevated position facing the audience, acts as a well-localized "point source", the microphone being located nearby in a working location to the rear of speaker. Despite this proximity, acoustic feedback and resultant "howl" tendencies are suppressed by providing both the microphone and the speaker unit with hypercardioid directivity and locating them in an offset back-to-back relationship such that alignment of their "null" regions combines their attenuation, minimizing feedback. In one embodiment, a lectern table supports the microphone in a working position and mounts an offset vertical pole carrying the speaker unit. The system amplifier may be housed within the lectern table. In an alternative floor stand embodiment a folding tripod base mounts a vertical pole carrying the speaker on top and supporting the microphone at a working height. In the speaker enclosure, a rear aperture provides hypercardioid directivity, while a front diffraction slot enhances the high frequency dispersion in a horizontal plane.

11 Claims, 1 Drawing Sheet

SOUND REINFORCEMENT SYSTEM

FIELD OF THE INVENTION

The present invention is in the field of electronic sound reinforcement, relating more particularly to an improved audio system for reinforcing speech in situations requiring an overall "natural" quality with a high level of fidelity and intelligibility, along with full audience coverage and localization of the source.

Extensive development of audio electronic technology has led to the present widespread use of sound amplification systems for reinforcing speech in a wide range circumstances ranging from large noisy crowds where the fidelity of reproduction may often be sacrificed for raw power and coverage, to a more refined scenario where a lecturer addresses a seriously attentive group of small to medium size, such as in a college auditorium. It is toward the latter general category that the present invention is directed, although the principles taught are broadly applicable in the field of reinforcing microphone-sensed sound.

BACKGROUND OF THE INVENTION

Despite the many advancements in the audio arts, reinforcement systems commonly fail to satisfy at least some portion of a serious audience. Such failures are not always due to basics such as insufficient gain or audio power capability and/or inferior or defective components such as microphones, amplifiers and loudspeakers: even with equipment components of excellent quality, capable of delivering adequate levels of gain and acoustic power, these capabilities often cannot be effectively realized because of a more subtle and complex limitation: positive acoustic feedback from the loudspeaker(s) to the microphone(s) reaching the threshold of instability corresponding to unity overall loop gain. The excessive unnatural reverberations and other distortions heard as this threshold is approached, and even worse, the uncontrolled acoustic "howl" that results when the threshold is exceeded, are common experiences, typically associated with unsuccessful efforts to adjust the system to remedy inadequate coverage of some portion of the audience.

In a typical scenario which is especially prone to such feedback problems, a loudspeaker is located to the rear of the stage, behind the lecturer, facing the microphone; such a set-up may result either from inexperience or from worthy intentions of having the reinforced sound originate from a location near the lecturer, since intuitively this would seen desirable. The capability and coverage of such a system would be severely limited by acoustic feedback.

Efforts to overcome such feedback problems have led to two general approaches:

(1) locating the loudspeaker at a long distance away from the microphone; while this approach helps to mitigate feedback, the perception of a "disembodied" amplified voice, typically much louder than the lecturer's own voice, originating from somewhere other than from the lecturer's location, is distracting and tends to strain the audience's attention;

(2) utilizing multiple loudspeakers at various locations throughout the audience; this approach can be effective in covering a large audience more completely, however the source displacement cited for approach (1) tends to compound to a further distracting confusion or loss of source localization for much of the audience, and a further loss of intelligibility may occur due to destructive standing wave patterns set up by interferences between two or more separated loudspeakers. Over long distances, as in large halls or worship places, or outdoors, arrival-time differences at listerners' ears can destroy intelligibility.

Acoustic feedback is strongly related to the directional properties of the microphone(s) and/or loudspeaker(s) in the system, in combination with their relative locations. Selecting both the microphone(s) and the loudspeaker configuration for special directional properties holds promise in addressing the problem of acoustic feedback while avoiding harmful side effects; however the potential benefits depend not only on judicious selection of directional components, but just as importantly on determining and maintaining optimal deployment. Failure to fulfill the potential benefits of directional components, even when well selected, is commonly caused by improper location of the components relative to each other and to the environment: a temporary of flexible setup is subject to location variations caused by operator inexperience or haste, while a fixed permanent installation may perpetuate improper locations.

Generally, it would be desirable to locate a speaker unit near the front of the stage; however, usually other stage usage requirements preclude a permanent or fixed installation at a preferred onstage location.

OBJECTS OF THE INVENTION

It is a primary object of the present invention to provide an improved sound reinforcement system directed particularly to reinforcing speech in a manner to maximize audience satisfaction generally through excellent articulation and intelligibility while overcoming common undesired side-effects of conventional art in this field such as multi-speaker interference, dislocation or loss of localization, and degradation due to acoustic feedback.

It is a further object in such a system that the reinforced sound originate from a sole loudspeaker source located at an elevated height in the vicinity of the original sound source to provide satisfactory spatial source identity and audience coverage.

It is further to the foregoing objects to provide a speaker unit and a microphone, both specially selected with regard to directional properties, mounted in a structure specially adapted to support both the microphone and the speaker unit in the vicinity of the lecturer in a controlled optimal spatial relationship which effectively utilizes the directional properties to provide improvements in the sound reinforcement function including maximizing intelligibility and audience coverage while minimizing acoustic feedback.

SUMMARY OF THE INVENTION

The foregoing objects have been realized in two particular embodiments of the present invention, one incorporating a lectern and another incorporating a floor stand. Both embodiments support the microphone and speaker unit in a predetermined optimal fixed feedback-suppressed spatial relationship in a portable structure which is easily set up on a stage or platform, and is readily removable.

BRIEF DESCRIPTION OF THE DRAWINGS

Further features and benefits of the present invention will become apparent from a study of the following description with reference to the accompanying drawings, in which.

DETAILED DESCRIPTION

Figure 1:
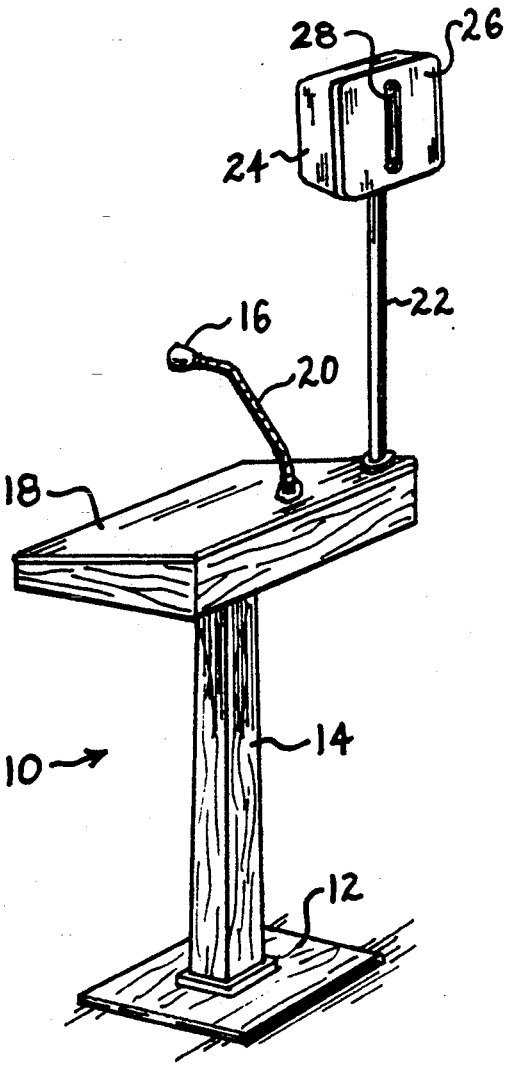
FIG. 1 is a perspective view of a microphone and speaker unit mounted on a lectern in a primary embodiment of an improved sound reinforcement system in accordance with the present invention.

In the perspective view of FIG. 1, a lectern 10, provided with a floor base 12 and pedestal 14, is fitted with a microphone 16 mounted centrally to the front of lectern table 18 by a flexible gooseneck adaptor 20 which holds microphone 16 aimed generally toward the normal location of the mounth of a lecturer standing behind the lectern 10. Gooseneck adaptor 20 also serves as a conduit for the microphone cable.

Attached to a front corner of the lectern table 18 is a vertical support pole 22, carrying at its upper end a speaker unit 24 in which the front baffle 26, provided with a vertical diffractive slot 28, faces forward, away from the lecturer's location, and may be angled downward slightly. Pole 22 is made hollow, serving as a conduit for speaker attachment wiring. An audio amplifier may be built into table 18 of lectern 10, which may also be fitted with a reading lamp. Power line wiring and/or audio cabling may be enclosed in pedestal 14 and brought out in the region of base 12.

Figure 2:
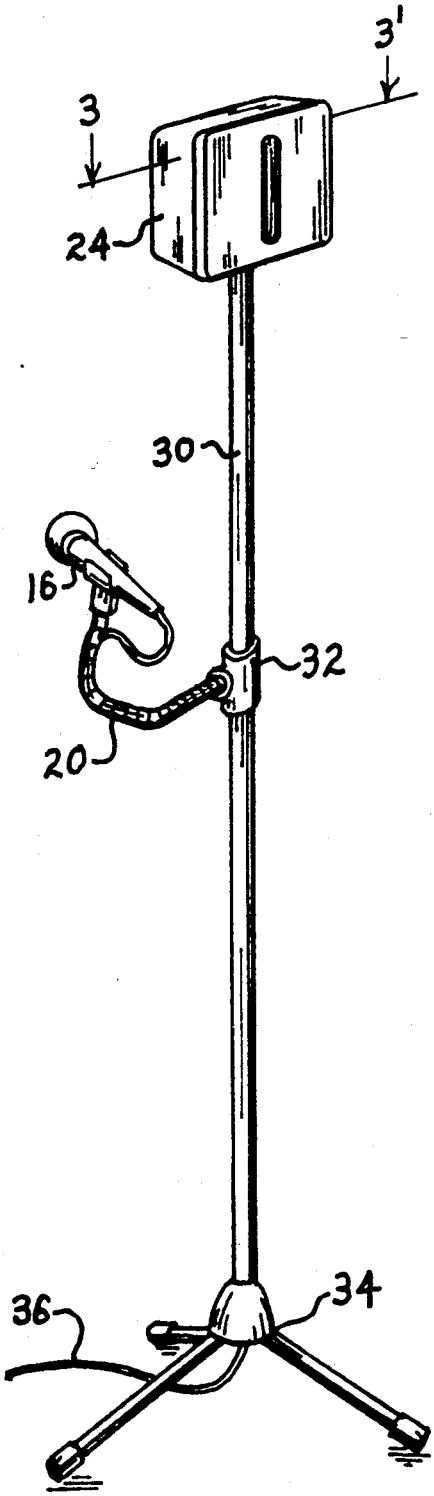
FIG. 2 is perspective view of a microphone and speaker unit mounted on a floor stand in an alternative embodiment of an improved sound reinforcement system in accordance with the present invention.

In an alternative embodiment shown in the perspective view of FIG. 2, a similar speaker unit 24 is mounted on top of a vertical column 30 of a floor stand which also carries a microphone 16 attached by a gooseneck adaptor 20 attached by a tee fitting 32 part way down from the top of pole 30, which is mounted in a base 34 of the folding tripod type. Pole 30 is made hollow, enclosing wiring from the speaker unit 24 and the cable from microphone 16, via gooseneck adaptor 20, while cable 36 at the bottom carries any external wiring required. Typically cable 36 would carry the cable from microphone 16 and the wiring for speaker unit 24 to an externally located amplifier; however if the amplifier were located on board the floor stand, cable 36 would typically carry the a.c. power line. Alternatively, the amplifier could be incorporated into a solid, box-like base, and could be battery-powered.

In both of the embodiments of FIG. 1 and FIG. 2, microphone 16 is chosen to have particular directional properties, providing high attenuation generally from the rear and particularly from the direction of speaker unit 24. Similarly the enclosure of speaker unit 24 is specially configured to minimize its rearward radiation, particularly in the direction of microphone 16, relative to its maximized forward radiation, the forward pattern being made to have a narrow vertical angle to minimize floor and ceiling reflections and a somewhat wider horizontal angle so as to adequately include the wings of the audience region.

In both of the embodiments of FIG. 1 and FIG. 2, the pole 22/30 is offset to one side of the microphone 16 so as not to obsure the face of the lecturer.

Figure 3:
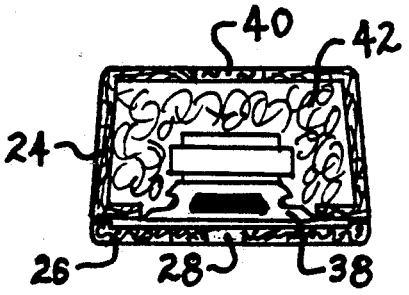
FIG. 3 is cross sectional view of the speaker unit of FIG. 2.

A cross sectional plan view of speaker unit 24 as viewed at 3—3' of FIG. 2 is shown in FIG. 3 as an example of a directional enclosure configuration suitable for implementing the present invention. A speaker driver 38 is mounted immediately behind baffle 26 in which the front diffraction slot 28 extends vertically over approximately the full vertical extent of the driver 38. A circular aperture 40 is provided at the rear of the enclosure and fitted with open-celled acoustically resistive material, and the enclosure is filled with fibroustangle acoustic material 42.

In particular realizations of the two embodiments described above which have been tested successfully, the microphone is typically located about 5' above floor level to approximate the location of a lecturer's mouth, which would normally be kept 6" to 12" away from the microphone. Locating the speaker unit at a height of about 7' places it just above the average lecturer's head level; it is offset approximately 1' to one side. The gooseneck extends the microphone's location to a plane about 1' behind the speaker unit, thus the microphone and speaker unit are situated back-to-back, separated by about 1', 2' and 1' in x, y and z axes respectively.

The key principles of this invention in avoiding positive acoustic feedback "howl" involve providing suitable directional properties in both the microphone and the speaker unit, determining optimal fixed physical locations relative to each other such that the attention provided by the two directivity patterns in the mutally offset direction combine to provide sufficient total attenuation of microphone pickup from the speaker unit, and the ensuring that the optimal component locations are maintained.

Utilizing a readily available basic cardioid directivity pattern in either or both the microphone and the speaker unit would be beneficial compared to non-directional components since the microphone and speaker unit are essentially behind each other even though offset at an oblique angle. However, for increased suppression of acoustic feedback, a hypercardioid pattern, which produces nulls at 150 and 210 degrees relative to the frontal direction, was chosen for both components as most effective and useful in the two configurations described in connection with FIGS. 1 and 2.

In the speaker enclosure 24, the front diffraction opening 28 receives energy from the driver 38 (FIG. 3) out to the highest frequency part of the spectrum, and is shaped as a vertically oriented slot as shown (FIGS. 1 and 2) to act as a narrow virtual source thus improving the high-frequency dispersion in the horizontal plane toward the front while restricting the vertical plane radiation so as to concentrate the radiated energy to where it is most wanted, improving intelligibility by curtailing delayed reflections from room boundaries. The rear aperture 40 (FIG. 3) is a port through which out-of-phase energy from the rear of the diaphagm emerges, with high frequencies attenuated by the box stuffing 42 and by resistive material (e.g. foam) in the aperture 40. At lower frequencies, in the approximate range of 100 to 1,000 Hz, front and rear waves cancel toward the rear of the enclosure, producing a region of null and thus creating the cardioid or hypercardioid directivity pattern.

The speaker driver 38 is a commercial 4" full range conventional permanent magnet/voice coil/cone type having sufficient power handling capability for the power of the amplifier involved.

In the particular embodiment shown, the speaker enclosure 24 is built of ½" medium density fiber board, or molded from a suitable plastic material, with outside dimensions approximately 6" square by 4" deep. The front baffle is made from plastic foam or equivalent non-reflective material. The front diffraction slot is made 3" high by ⅞" wide, located centrally in the front baffle 26. The rear aperture 40 is made circular, 2" in diameter; located centrally in the rear panel. Damping material 42 is polyester fiber or equivalent acoustic fill material. The speaker is tilted downward at an angle of 10 to 15 degrees, depending on the height of the stage or platform relative to the audience region.

The foregoing dimensions represent typical values which will enable the construction and practice of the invention in a particular illustrative embodiment. However these dimensions should not be considered critical; there is considerable latitude within which the invention may be practiced successfully. For example the directional properties of the speaker unit 24 may be "tailored" by modifying the size, location and/or shape of the front diffraction slot 28 and/or the rear aperture 40.

There is considerable information available in public literature regarding speaker drivers and enclosures having particular properties including directivity, from which it would possible to fabricate alternative speaker unit configurations suitable for practicing the present invention. Known art in the field of directional speakers is typified in the following U.S. Pat. Nos.: 2,646,851 to Chapman et al, 3,722,616 to Beavers, 4,377,219 and 4,387,787 to King, 4,437,541 to Cross and 4,445,227 to Leiendecker et al.

An important objective is to keep the size of the speaker unit 24 relatively small; this is feasible since the low frequency cutoff may be as high as 300 Hz without impairing speech reproduction, and judicious attenuation of low frequencies actually enhances intelligibility. The speaker driver 38 could alternatively be of the dome type.

Using a Shure model SM58 hypercardioid microphone along with a Pioneer A11EC80-02F 4" full-range driver in the speaker enclosure configured and relatively located as described herein, the resulting alignment of the microphone and speaker unit directivity patterns eliminated acoustic feedback "howl" under almost all practical conditions despite the close spacing between the microphone and the speaker unit, and 20 watts of audio power adequately covered a 2000-square-foot listening area.

There are a number of variations of the two embodiments disclosed with which the principles of this invention may be practiced; for example the lectern 10 of FIG. 1 could be made in a variety of styles; and may be provided with various means of detaching and disconnecting the speaker unit 24 and support column 22. In either FIG. 1 or FIG. 2 the speaker unit 24 could be suspended from overhead, eliminating support column 22/30, and providing means ensuring the desired relative location of the base 12/34. In some situations base 12/34 may be fastened down to a permanent location. In FIG. 2, other stable base support configurations could be utilized instead of the folding tripod style shown; and the entire assembly could be made collapsible, utilizing detachable elements.

To optionally center speaker unit 24 an additional horizontal upper portion of column 22/30 could be extended toward the left of FIG. 1/FIG. 2, and could be coupled into the side of speaker unit 24.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An improved sound reinforcement system, for use in a location adjacent to an audience region, comprising, in combination:

a directional microphone chosen to provide a directivity pattern characterized by substantially attenuated sensitivity within a designated insensitive portion of a hemispheric rear region beyond 90 degrees from a forward direction of the microphone;

a directional speaker unit, energized from an audio power amplifier receiving input from said microphone, having directivity means for providing a directivity pattern characterized by substantially attenuated response within a designated attenuated portion of a hemispheric rear region beyond 90 degrees from a forward direction of the speaker unit; and a support structure comprising:

a rectangular lectern table attached to a floor base by pedestal means;

microphone support means attached to said microphone and to the table; and a hollow rigid vertical pole, attached at a lower end to the table in a corner region thereof, supporting at an upper end the speaker unit and enclosing wiring associated with the speaker unit;

said support structure being configured to locate said microphone at a normal working height facing away from the audience region, and to hold said speaker unit facing said audience region at a designated height above said microphone, the microphone and the speaker unit being located in close proximity in the order of a few feet, said microphone being located within the designated attenuated portion of the rear region of said speaker unit and said speaker unit being located within the designated insensitive portion of the rear region of said microphone;

whereby suppression of acoustic feedback from said speaker unit to said microphone enables the system to effectively reinforce sound sensed by the microphone and project the reinforced sound to the audience region with a high degree of fidelity, clarity, intelligibility and original-source localization.

2. The improved sound reinforcement system as defined in claim 1 wherein said speaker unit comprises a permanent magnet/voice coil/diaphragm type driver housed in a rectangular enclosure adapted to widen frontal dispersion in a horizontal plane and to attenuate sound radiation in the designated portion of the rear region in accordance with the directivity pattern.

3. The improved sound reinforcement system as defined in claim 1 wherein said microphone is made to have a hypercardioid directivity pattern.

4. The improved sound reinforcement system as defined in claim 1 wherein said speaker unit is made to have a hypercardioid directivity pattern.

5. The improved sound reinforcement system as defined in claim 1 wherein the audio power amplifier is housed in said lectern table.

6. The improved sound reinforcement system as defined in claim 1 wherein said microphone support means comprises a gooseneck type flexible adaptor enclosing a cable of said microphone.

7. An improved sound reinforcement system, for use in a location adjacent to an audience region, comprising, in combination:

a directional microphone chosen to provide a directivity pattern characterized by substantially attenuated sensitivity within a designated insensitive portion of a hemispheric rear region beyond 90 degrees from a forward direction of the microphone;

a directional speaker unit, energized from an audio power amplifier receiving input from said microphone, having directivity means for providing a directivity pattern characterized by substantially attenuated response within a designated attenuated portion of a hemispheric rear region beyond 90 degrees from a forward direction of the speaker unit; and a support structure comprising:

a floor base;

a hollow vertical pole, supported at a lower end thereof by the floor base, supporting said speaker unit at an upper end of the pole, and enclosing wiring associated with the speaker unit; and microphone support means attached to said vertical pole at a location between said speaker unit and the base;

said support structure being configured to locate said microphone at a normal working height facing away from the audience region, and to hold said speaker unit facing said audience region at a designated height above said microphone, the microphone and the speaker unit being located in close proximity in the order of a few feet, said microphone being located within the designated attenuated portion of the rear region of said speaker unit and said speaker unit being located within the designated insensitive portion of the rear region of said microphone;

whereby suppression of acoustic feedback from said speaker unit to said microphone enables the system to effectively reinforce sound sensed by the microphone and project the reinforced sound to the audience region with a high degree of fidelity, clarity, intelligibility and original-source localization.

8. The improved sound reinforcement system as defined in claim 7 wherein said microphone support means comprises a gooseneck type flexible adaptor enclosing a first portion of a cable of said microphone, and wherein said vertical pole encloses a second portion of the cable of said microphone, the cable and the speaker unit wiring exiting from a lower region of the vertical pole.

9. The improved sound reinforcement system as defined in claim 7 wherein said speaker unit comprises a permanent magnet/voice coil/diaphragm type driver housed in a rectangular enclosure adapted to widen frontal dispersion in a horizontal plane and to attenuate sound radiation in the designated portion of the rear region in accordance with the directivity pattern.

10. The improved sound reinforcement system as defined in claim 7 wherein said microphone is made to have a hypercardioid directivity pattern.

11. The improved sound reinforcement system as defined in claim 7 wherein said speaker unit is made to have a hypercardioid directivity pattern.

* * * * *